US012172811B2

(12) United States Patent
Hodsdon et al.

(10) Patent No.: US 12,172,811 B2
(45) Date of Patent: Dec. 24, 2024

(54) FLEXIBLE FASTENING STRAP

(71) Applicant: Velcro IP Holdings LLC, Manchester, NH (US)

(72) Inventors: Jerry G. Hodsdon, Manchester, NH (US); David D. Cianciolo, Sandown, NH (US); James L. Tardiff, Manchester, NH (US)

(73) Assignee: Velcro IP Holdings LLC, Manchester, NH (US)

( * ) Notice: Subject to any disclaimer, the term of this patent is extended or adjusted under 35 U.S.C. 154(b) by 0 days.

(21) Appl. No.: 18/396,887

(22) Filed: Dec. 27, 2023

(65) Prior Publication Data

US 2024/0228137 A1 Jul. 11, 2024

Related U.S. Application Data

(60) Provisional application No. 63/438,023, filed on Jan. 10, 2023.

(51) Int. Cl.
*A44B 18/00* (2006.01)
*B65D 63/10* (2006.01)

(52) U.S. Cl.
CPC ..... *B65D 63/10* (2013.01); *A44B 18/0084* (2013.01); *Y10T 24/27* (2015.01)

(58) Field of Classification Search
CPC ..... Y10T 428/24017; Y10T 24/27; B65D 63/1018; B65D 2313/02; A44B 18/0084
See application file for complete search history.

(56) References Cited

U.S. PATENT DOCUMENTS

| | | | | |
|---|---|---|---|---|
| 4,126,166 | A * | 11/1978 | Hohenstein | A63B 60/62 206/315.6 |
| 4,411,049 | A * | 10/1983 | Cristea | B65D 63/02 24/20 EE |
| 5,048,158 | A | 9/1991 | Koerner | |
| 5,133,671 | A | 7/1992 | Boghosian | |
| 5,260,015 | A | 11/1993 | Kennedy et al. | |
| 5,289,619 | A | 3/1994 | Pileggi | |
| 5,312,387 | A | 5/1994 | Rossini et al. | |
| 5,518,795 | A | 5/1996 | Kennedy et al. | |
| 5,603,708 | A | 2/1997 | Seth | |
| 5,759,317 | A | 6/1998 | Justmann | |
| 5,802,676 | A | 9/1998 | Tolman | |
| 5,870,849 | A | 2/1999 | Colson, Jr. | |
| 5,894,640 | A * | 4/1999 | Dewey | A43C 11/00 24/575.1 |
| 5,996,189 | A | 12/1999 | Wang | |
| 6,044,525 | A | 4/2000 | Sastre et al. | |
| 6,226,844 | B1 | 5/2001 | Lerra et al. | |
| 6,235,369 | B1 | 5/2001 | Shepard et al. | |

(Continued)

OTHER PUBLICATIONS

International Search Report and Written Opinion in International Appln. No. PCT/US2023/085971, mailed on May 15, 2024, 11 pages.

*Primary Examiner* — Robert Sandy
*Assistant Examiner* — Michael S Lee
(74) *Attorney, Agent, or Firm* — Fish & Richardson P.C.

(57) ABSTRACT

An elongated fastening strap of touch fastener material has a head with a grommet defining a slot through which the other end of the strap is received. Selective interference at the ends of the slot with the width of the strap alter the resistance to motion within the slot. The grommet provides a smooth surface within the slot.

18 Claims, 10 Drawing Sheets

(56) References Cited

U.S. PATENT DOCUMENTS

| | | | | |
|---|---|---|---|---|
| 6,256,845 | B1 | 7/2001 | Tseng | |
| 6,317,933 | B1 | 11/2001 | Suenaga | |
| 6,546,603 | B1 | 4/2003 | Wang et al. | |
| 6,551,539 | B1 | 4/2003 | Leach et al. | |
| 6,701,580 | B1 | 3/2004 | Bandyopadhyay | |
| 8,413,306 | B2 | 4/2013 | Gallant et al. | |
| D1,021,688 | S | 4/2024 | Cardinali | |
| 2005/0186387 | A1 | 8/2005 | Gallant et al. | |
| 2007/0264469 | A1* | 11/2007 | Gallant | B29C 43/222 428/100 |
| 2008/0201915 | A1 | 8/2008 | Obiols et al. | |
| 2009/0282654 | A1 | 11/2009 | Gallant | |
| 2010/0101580 | A1* | 4/2010 | Stumm | A61M 16/0683 128/205.25 |
| 2011/0247184 | A1 | 10/2011 | Jackson et al. | |
| 2011/0252608 | A1 | 10/2011 | Rothbaum et al. | |
| 2019/0308785 | A1 | 10/2019 | Grady et al. | |

* cited by examiner

FLEXIBLE FASTENING STRAP

TECHNICAL FIELD

This invention relates to flexible fastening straps, and more particularly to such straps with heads defining slots for receiving an opposite end of the strap.

BACKGROUND

As an alternative to rope or twine, fastening straps with touch fastening elements can be easily manipulated to secure objects without the necessity of tying knots and without heavy structural buckles. Some of the simplest such straps are lengths of two-sided fastener material, with one side carrying a field of male fastener elements such as hooks, and the other a field of female fastener elements, such as loops or engageable fibers. Wrapping the strap about an object such that one side overlays and contacts the others results in a releasable engagement that can be undone by peeling the two engaged sides apart.

Various improvements in such straps have been made. For example, some such straps now have an enlarged head at one end that defines a slot through which the other end can be passed. Further improvements are sought.

SUMMARY

Various aspects of the invention feature an elongated fastening strap, including a length of flexible material with two opposite faces bounded by lateral edges extending along the length of flexible material, and mutually engageable touch fastener elements carried on the faces of the flexible material to releasably fasten overlapping portions of the flexible material together with the fastening strap wrapped about an object.

According to one aspect of the invention, the length of flexible material has a perimeter shaped to form a head and a tail extending from the head to a distal end opposite the head, the tail having lateral edges defining a nominal width between them. The strap also includes a grommet of greater thickness than the flexible material and secured to overlay the head on two opposite sides of the head. The head defines, at the grommet, a transverse slot of a length sufficient to receive through the slot the distal end of the tail.

In some embodiments, the grommet forms an inner edge of the slot.

In some examples, the head is formed by two layers of the flexible material, joined at a fold. Preferably, the head has exposed surfaces carrying engageable loop fibers. The two layers may be permanently welded together across the head, for example.

In some cases, the nominal width is constant along the strap, other than at the head and, in some cases, adjacent the distal end of the tail.

In some embodiments, the tail includes an interference section, extending from the head toward the distal end of the tail a distance of at least half an overall length of the head and less than an overall length of the tail, in which the tail is of cross-sectional dimensions selected to define an interference fit with respect to the slot, such that when the interference section is manually pulled into the slot, friction in the slot retains the tail in the slot.

In some cases, the interference section features two overlapped layers of the flexible material.

In some examples, the slot length is at least as great as the nominal width in the interference section, the slot having curved ends that reduce the slot length toward sides of the slot and the interference section being of sufficient cross-section thickness that corners of the tail cross-section interfere with the curved ends of the slot.

The nominal width may be greater along the interference section of the tail than in a distal section of the strap extending from the interference section to the distal end. The transverse slot length may be between 3.0 and 8.0 percent greater than the nominal width of the tail in the distal section, for example.

In some embodiments, the tail includes an undulating width portion at an end of the interference section opposite the head, along which the width of the tail fluctuates between local minima and maxima, the width of the tail at the maxima selected to cause interference in the slot as the undulating width portion is pulled through the slot.

In some examples, the flexible material includes, or is in the form of or consists of, a laminate of a loop material forming one of the two opposite faces of the flexible material, and a resin layer carrying male touch fastener elements and forming the other of the two opposite faces of the flexible material.

In some cases, the loop material comprises or is a knit material. In some cases, the loop material comprises or is a non-woven material.

In some embodiments, the grommet features or is fashioned of molded resin. In some cases, the touch fastener elements carried on one of the two opposite faces have discrete resin stems extending from a layer of resin, and the molded resin of the grommet is of a higher durometer than the layer of resin. The molded resin of the grommet may have a hardness of between 60 and 80 Shore D, for example.

In some configurations, the grommet consists of two identical grommet halves, each grommet half having a flange overlaying a respective side of the flexible material adjacent the slot.

In some cases, the grommet halves are joined at a perimeter of the slot to form an inner edge of the slot.

The grommet halves may be welded together about the slot, for example.

The transverse slot length, in some examples, is between 3.0 and 8.0 percent greater than the nominal width of the tail.

According to another aspect of the invention, the length of flexible material has a perimeter shaped to form a head joined to a tail at a neck, the tail extending to a distal end opposite the head. The head has an overall length, from the neck to an outer edge of the head opposite the tail, and defines through the head a transverse slot with bounded ends, the slot sized to freely receive the distal end of the tail. The tail includes an interference section, extending from the neck toward the distal end of the tail a distance of at least half the overall length of the head and less than an overall length of the tail, in which the tail is of cross-sectional dimensions selected to define an interference fit with respect to the slot, such that when the interference section is manually pulled into the slot, friction in the slot retains the tail in the slot.

In some embodiments, the interference section features or consists of two overlapped layers of the flexible material.

The head, in some examples, is formed by two layers of the flexible material, joined at a fold, the two layers extending along the interference section. The overlapped layers preferably have exposed surfaces carrying engageable loop fibers. The two layers may be permanently welded together across the head and along the interference section, for example. In some cases, the tail has an overall width that is constant along both the interference section and a portion of the tail beyond the interference section.

In some embodiments, the slot length is at least as great as a nominal width of the tail in the interference section, the slot having curved ends that reduce the slot length toward sides of the slot and the interference section being of sufficient cross-section thickness that corners of the tail cross-section interfere with the curved ends of the slot.

In some cases, the tail is of greater width along the interference section of the tail than in a distal section of the tail extending from the interference section to the distal end of the tail. The transverse slot length may be, for example, between 3.0 and 8.0 percent greater than a nominal width of the tail in the distal section.

In some embodiments, the tail includes an undulating width portion at an end of the interference section opposite the head, along which the tail is of width that fluctuates between local minima and maxima, the width of the tail at the maxima selected to cause interference in the slot as the undulating width portion is pulled through the slot.

In some examples, the flexible material comprises or is in the form of or consist of a laminate of a loop material forming one of the two opposite faces of the flexible material, and a resin layer carrying male touch fastener elements and forming the other of the two opposite faces of the flexible material. The loop material may feature, or consist of, a knit material or a non-woven material, for example.

In some embodiments, the strap also has a grommet of greater thickness than the flexible material and secured to overlay the head on two opposite sides of the head, with the slot extending through the grommet. The grommet may be of molded resin, for example, and may consist of two identical grommet halves, each grommet half having a flange overlaying a respective side of the flexible material adjacent the slot. Alternatively, the grommet may be molded in place onto the flexible material of the head.

According to another aspect of the invention, the length of flexible material is folded to have a perimeter shaped to form a head joined to a tail at a neck, the tail extending to a distal end opposite the head. The head defines through the head a transverse slot with bounded ends, the slot sized to freely receive the distal end of the tail. The head has or features or consists essentially of two overlapping layers of the length of flexible material joined at a fold, with the slot extending through both of the two overlapping layers and with only one of the two overlapping layers extending to the distal end of the tail.

Preferably, the head has exposed surfaces carrying engageable loop fibers.

In some cases, the two layers are permanently welded together across the head.

In some embodiments, the two layers are overlapped along an interference section of the tail, extending from the neck toward the distal end of the tail a distance less than an overall length of the tail, in which the tail is of cross-sectional dimensions selected to define an interference fit with respect to the slot, such that when the interference section is manually pulled into the slot, friction in the slot retains the tail in the slot.

In some cases, the tail has an overall width that is constant along both the interference section and a portion of the tail beyond the interference section.

In some examples, the slot has a length between the bounded ends that is at least as great as a nominal width of the tail in the interference section, the slot having curved ends that reduce the slot length toward sides of the slot and the interference section being of sufficient cross-section thickness that corners of the tail cross-section interfere with the curved ends of the slot.

In some examples, the tail is of greater width along the interference section of the tail than in a distal section of the tail extending from the interference section to the distal end of the tail.

In some embodiments, the tail includes an undulating width portion at an end of the interference section opposite the head, along which the tail is of width that fluctuates between local minima and maxima, the width of the tail at the maxima selected to cause interference in the slot as the undulating width portion is pulled through the slot.

In some embodiments, the flexible material comprises or consists essentially of a laminate of a loop material forming one of the two opposite faces of the flexible material, and a resin layer carrying male touch fastener elements and forming the other of the two opposite faces of the flexible material. The loop material may be, for example, a knit material or a non-woven material, or in some cases a woven material.

Some examples of the strap also have a grommet of greater thickness than a combined thickness of the overlapped layers of flexible material in the head and secured to overlay the overlapped layers on two opposite sides thereof, the slot extending through the grommet.

The grommet may be of molded resin, for example. In some cases, the grommet consists of two identical grommet halves, each grommet half comprising a flange overlaying a respective side of the flexible material adjacent the slot. Preferably, the grommet forms an inner edge of the slot.

Yet another aspect of the invention features a method of making a fastener strap, including cutting a length of two-sided fastener material and folding one end to form an enlarged two-layer head defining a slot for receiving a tail of the strap. Another aspect of the invention features cutting the length of fastener material to form a strap with a head, and securing a grommet of greater thickness than the fastener material to the head, with a slot defined through the grommet for receiving the tail of the strap.

The various concepts described herein can be employed to provide a useful strap that can be produced at acceptable costs and with improved utility. Doubling of the material in the head and/or providing the described grommet can enhance both the feel and function of the head of the strap, such as by reducing the chance of unintended engagement during threading and enhancing the strength of the edges of the aperture, resulting in a strap much more suitable for high strength, heavy duty use, while the engagement of various portions of the edges of the strap with the ends of the slot can provide additional utility.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
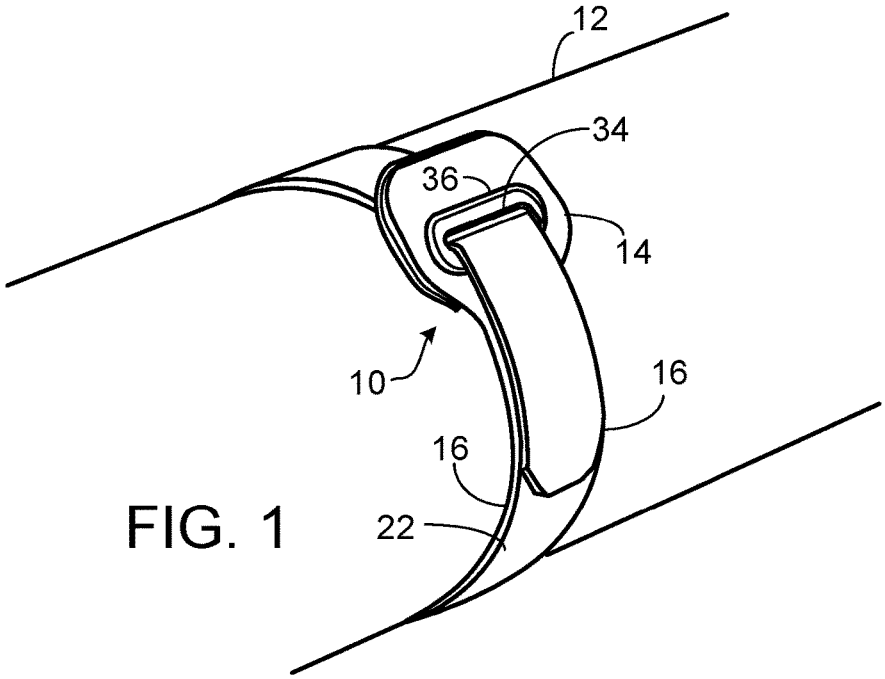
FIG. 1 shows a flexible fastening strap wrapped about an object.

Referring first to FIG. 1, a flexible fastening strap 10 is shown wrapped about an object 12, such as a bundle of cables or sticks. One end of the strap features an enlarged head 14 defining a slot through which the distal end 16 of the strap is inserted. As will be discussed in more detail below, one broad side of the strap carries a field of male touch fastener elements such as hooks, and the other broad side or face of the strap carries a field of female touch fastener elements that releasably engage with the male fastener elements on contact or with light pressure, so that when the strap is wrapped about an object to overlie itself, the fastener elements engage to form a releasable fastening that holds the strap about the object. To release, the strap is peeled back starting at its distal end 16 until the portion of the strap from end 16 to the slot through head 14 is free of engagement.

Figure 2:
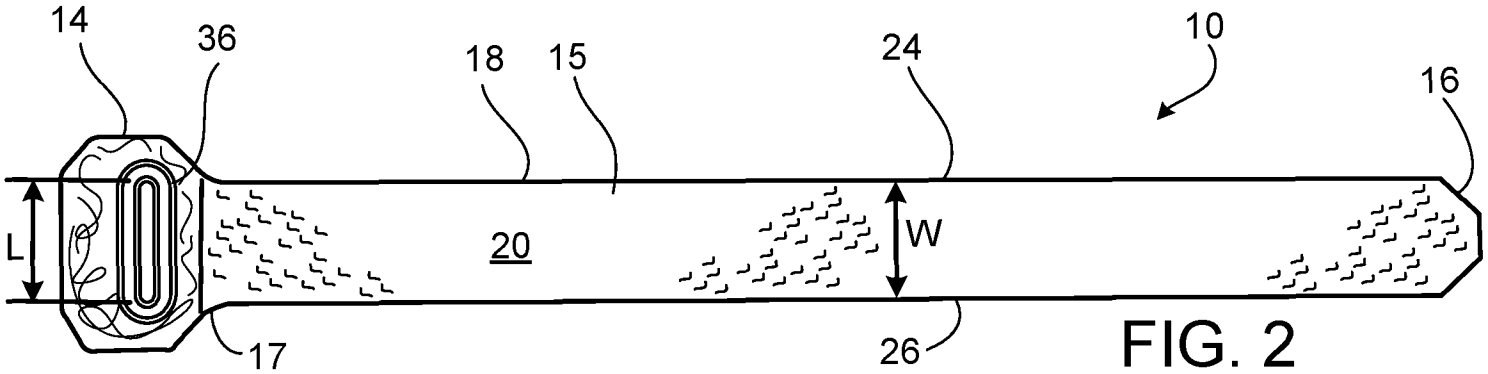
FIG. 2 is a top view of the strap of FIG. 1.
Figure 3:
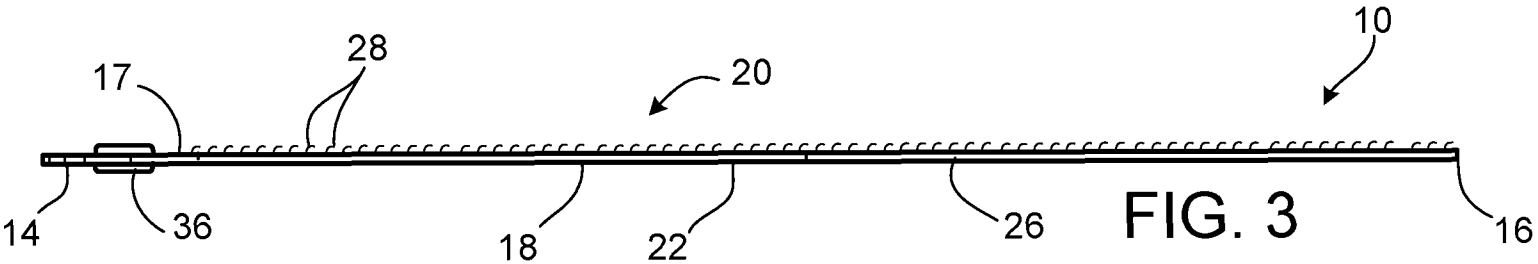
FIG. 3 is a side view of the strap of FIG. 1.
Figure 4:
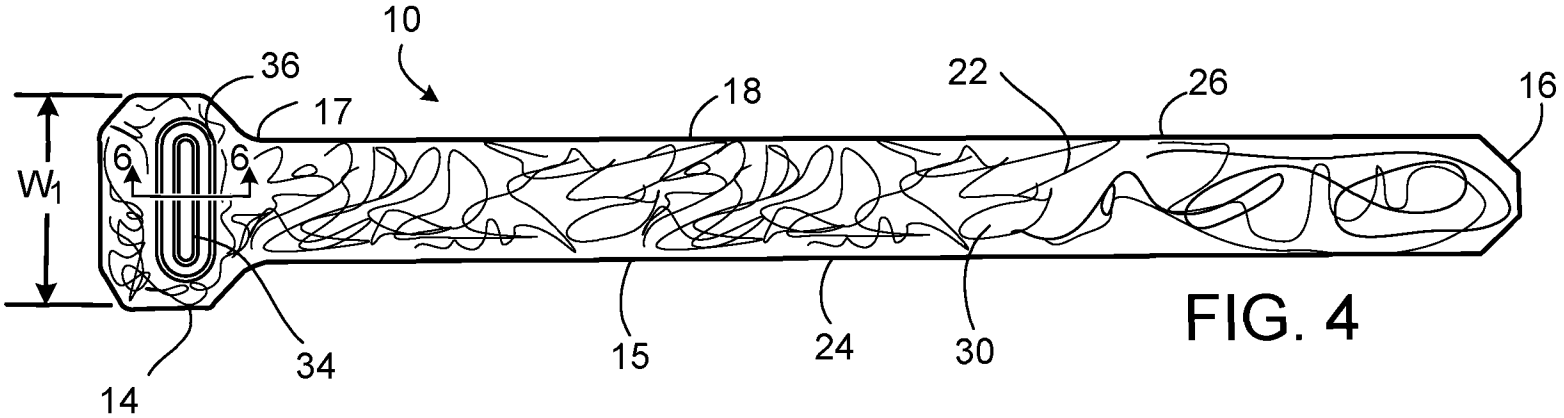
FIG. 4 is a bottom view of the strap of FIG. 1.

Referring next to FIGS. 2-4, strap 10 is in the form of a length of flexible material 18 with two opposite faces 20 and 22 bounded by lateral edges 24 and 26 extending along the length of flexible material. Mutually engageable touch fastener elements are carried on the faces of the flexible material to releasably fasten overlapping portions of the fastener material together with the fastening strap wrapped about an object. These include male touch fastener elements 28 on face 20 and female touch fastener elements 30, in the form of an exposed woven, knit or non-woven material, on face 22. The flexible material may be, for example, ONE-WRAP® HTH 888, available from Velcro USA Inc., which is an in situ laminate of Nylon lightweight knit loop 3610 and a polyethylene layer with molded J-hooks that can be mated with itself.

The length of flexible material 18 has two opposite ends, including a head end or head 14 and a tail 15 joined at the head 14 at a neck 17 and extending to a distal end 16. The lateral edges 24 and 26 define a nominal width W between them along the tail. In this example, the width W of the strap is constant along the entire length of a central region of the tail, extending from head 14 to distal end 16.

As shown, the head end 14 of the length of flexible material 18 has a width W1 greater than the nominal width W, and the fastening strap defines, at the head end 14 of the length of flexible material, a transverse slot 34 of a length L sufficient to receive through the slot the distal or tail end 16 of the length of flexible material. The slot 34 is bounded by a grommet 36 of greater thickness than the flexible material, overlaying the head 14 on two opposite sides of the head.

Figure 5:
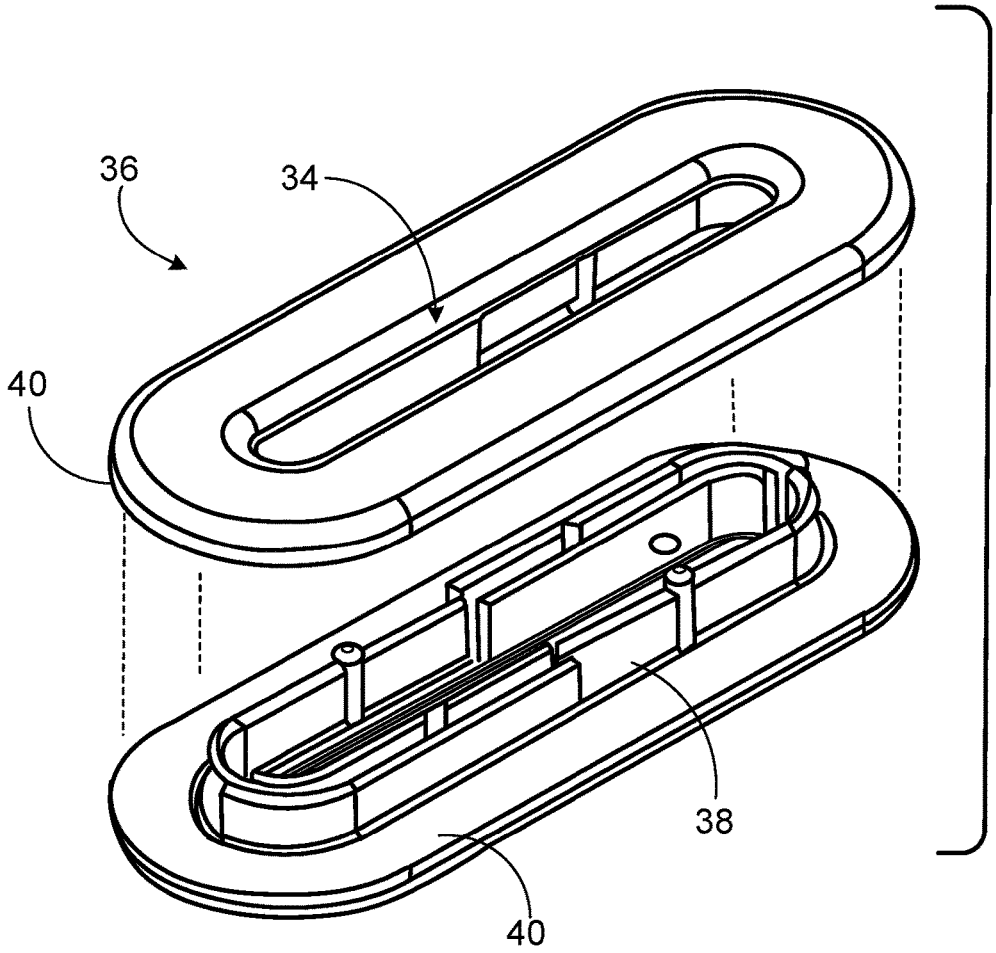
FIG. 5 is an exploded view of the grommet of the strap of FIG. 1.
Figure 6:
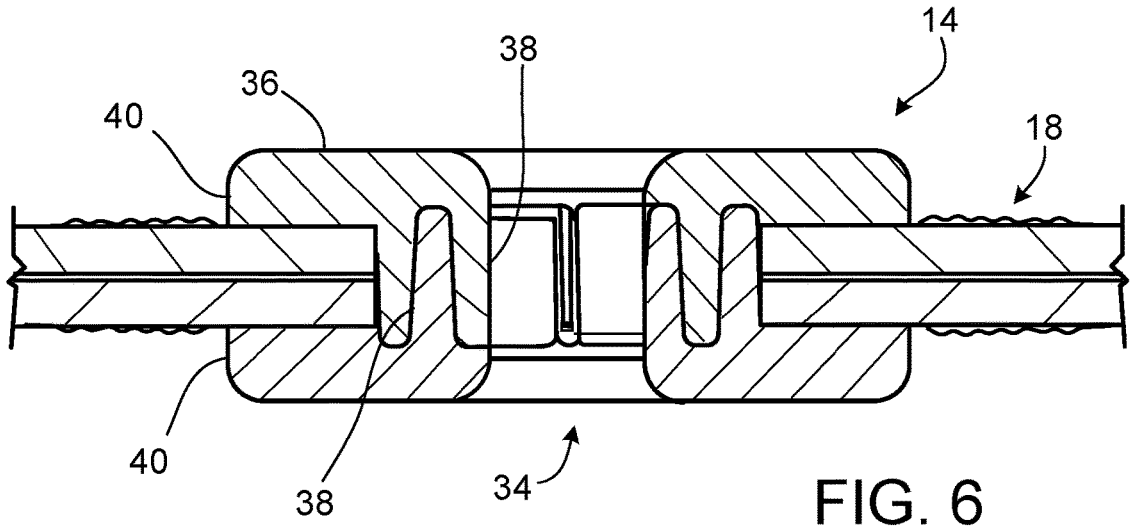
FIG. 6 is a cross-sectional view, taken along line 6-6 in FIG. 4.

Referring next to FIG. 5, grommet 36 is formed of two identical pieces of molded ABS plastic. The pieces have identical stem portions 38 that connect together to form the surfaces bounding the slot, and a flange portion 40 that overlies a respective side of the head. Referring also to FIG. 6, the stems 38 of the grommet pieces interlock within an aperture formed in the flexible strip material and remain interlocked during use, either by a snap or friction fit, or by adhesive or ultrasonic welding. FIG. 6 also shows the flange portions 40 extending over the strip material about the aperture. As best seen in this figure, the slot 34 is completely bounded, through the thickness of the grommet, by grommet material. In other words, there are no exposed edges of strip material 18 within the slot. Grommet 36 forms a very smooth sliding surface in slot 34 for the strap material to pass through. Bounding the slot fully with the molded grommet also helps to maintain very stable and consistent slot dimensions. The grommet material preferably has a durometer of about 60 to 80 Shore D.

FIG. 6 also illustrates that the head 14 of the strap has a double layer of strip material 18, making it twice as thick as the rest of the strap. In this manner, the head end of the strap has two overlapping layers of the flexible material joined at a fold, with the slot extending through both of the two overlapping layers and with only one of the two overlapping layers extending to the tail end of the strap. This structure may be formed, starting with a die cut piece of strip material 18, in a sequence illustrated in FIG. 7A. The material is preferably folded to have loop exposed on both sides of the head, making it more comfortable to grasp and also providing a cleaner appearance after sonic welding than with the hook side facing out.

Figure 7:
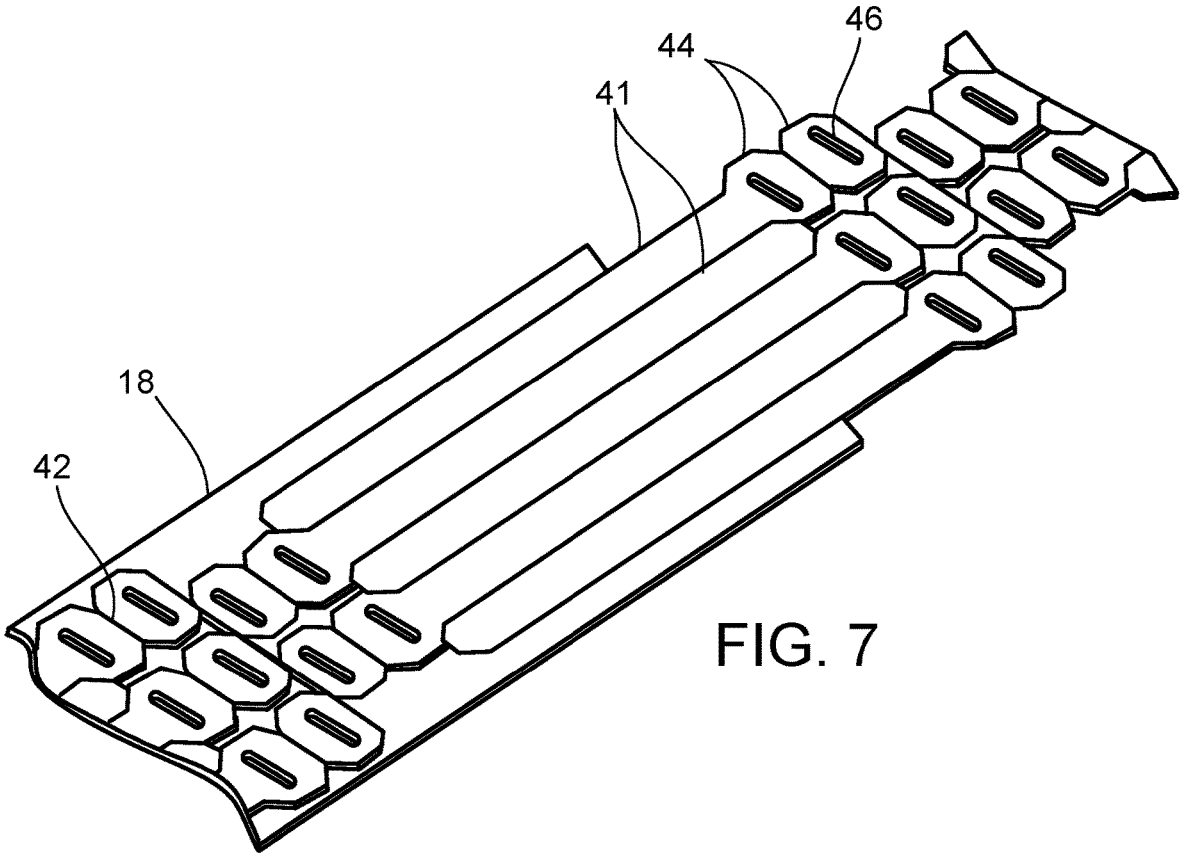
FIG. 7 is a perspective view of a set of nested straps die cut from a length of fastening material.

Referring to FIG. 7, a continuous length of flexible material 18 can be die cut to form a set of nested strap preforms 41, each having a stem and a double head, with little waste between straps. The strip material 18, prior to die cutting, already carries hook elements on one side and exposed fibers on the other side, and can be made with an in situ lamination process described by Kennedy et al. in U.S. Pat. No. 5,518,795, incorporated herein by reference, in which the male fastener elements are integrally molded with the resin forming one side of the strip.

Figure 7A:
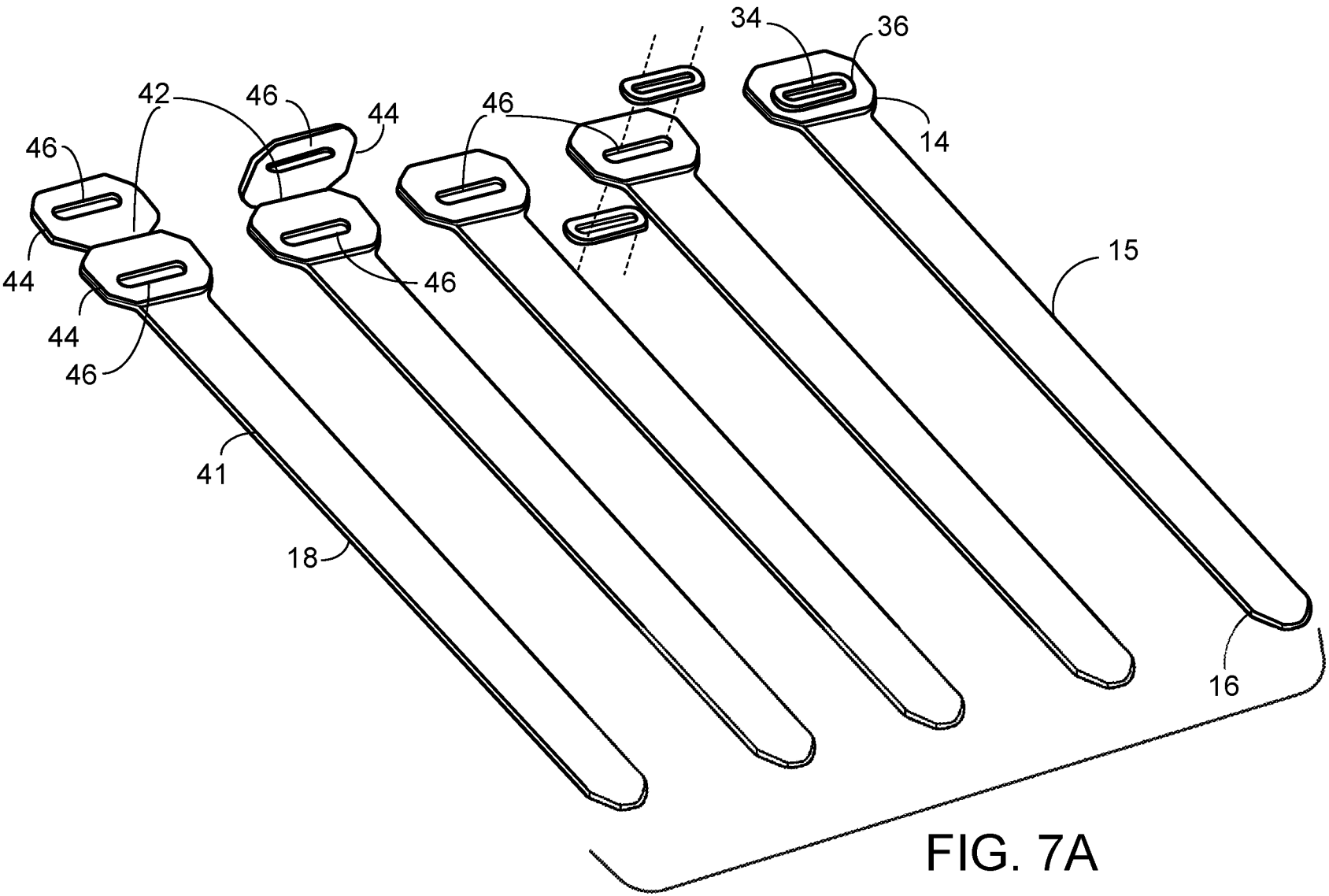
FIG. 7A illustrates the method of assembly of the strap of FIG. 1.

Referring to FIG. 7A, each strap preform 41 is a flat die cut piece of strip material 18 (at the far left of the figure) with a score or perforation line 42 between adjacent head portions 44, each defining a die cut aperture 46. In this example, the broad side 20 facing upward carries the male fastener elements. Next, the die cut strip is folded at the perforation line so that the two head portions 44 overlie each other with the apertures 46 aligned (second image from the left), forming a double thickness head area with exposed loop fibers on both sides after folding (third image from the left). This folding brings two hook-bearing surfaces into direct contact. The folded head may be processed in a way that melts or otherwise flows resin from the hooks to form an adhesive holding the head in its folded state. Alternatively, the hooks in head portions 44 can be removed, such as by skiving, before folding. Or, given that the hooks themselves are particularly small (on the order of 0.4 mm in height), the two hook portions can just be held in a folded state by adhesive applied between the hooks, or merely by the grommet itself.

With the head folded, the grommet pieces are applied from opposite sides of the head, with the stems of the grommet pieces extending into the aperture 46 and interlocking to form the grommet 36 defining slot 34, as seen in the far right image of FIG. 7A. One process of securing the folded head is to sonically weld the inner faces of the two layers of flexible material together, with the facing hooks forming energy directors that help concentrate ultrasonic energy. The resin of the hooks flows during welding to permanently join the two layers of material. After the head is welded (the middle illustration of FIG. 7A), the two halves of the grommet are assembled and ultrasonically welded together, further compressing the folded, welded material. Alternatively, the head material can be folded and then the grommet applied and welded, with the welding either only taking place between the two grommet halves, or simultaneously between the grommet halves and between the hook surfaces, by appropriately contouring the sonic horn surfaces.

As another embodiment, the strap can be in the form of the middle illustration of FIG. 7A, with the head folded and welded but without any grommet.

Figure 8:
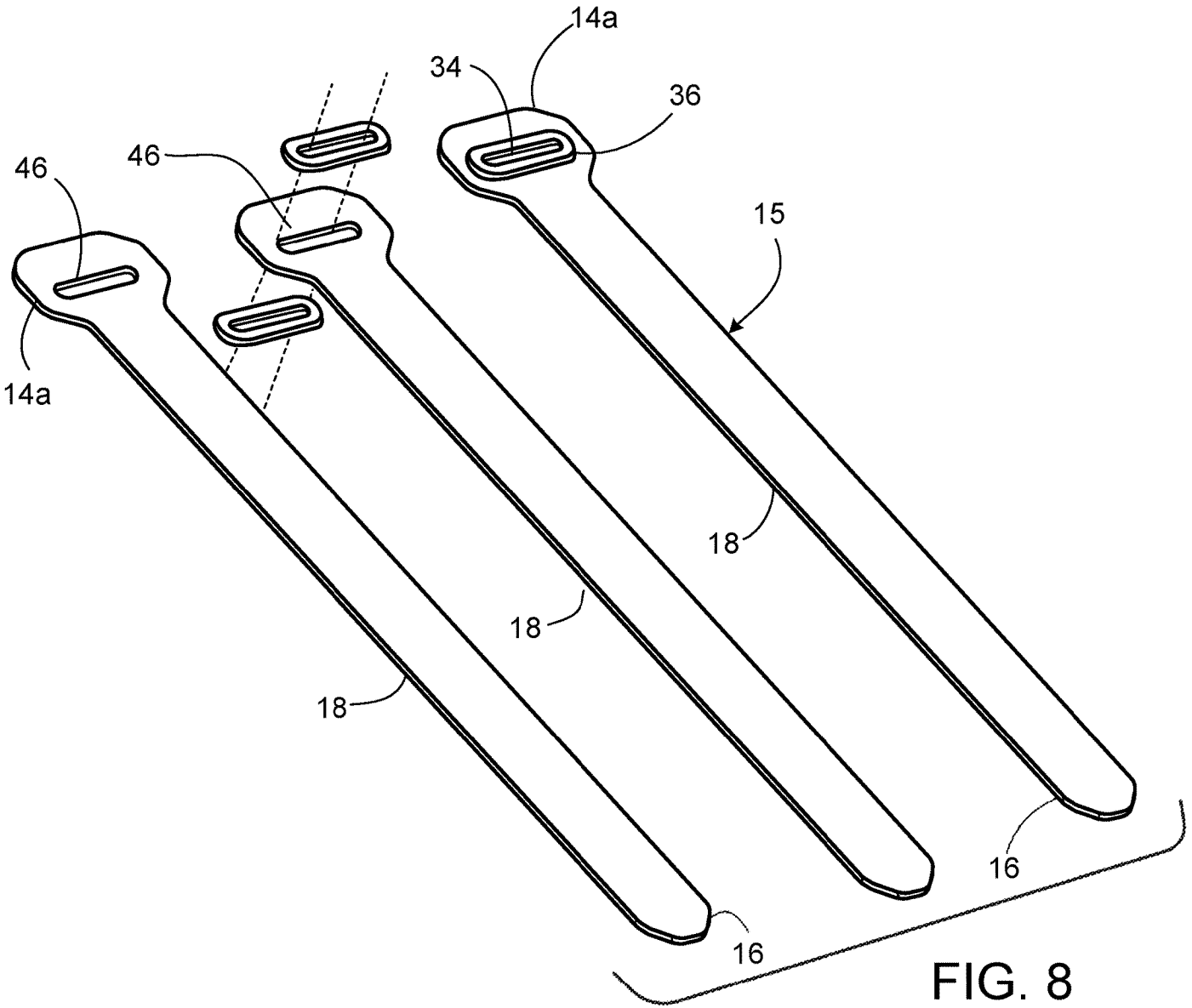
FIG. 8 illustrates the method of assembly of another strap.

Alternatively, the strap can be formed without a double-thickness head. FIG. 8 shows a process of forming such a strap from a single layer of flexible material 18, die cut in the outline of the finished strap and defining aperture 46 in the head 14*a*. The two grommet pieces are then connected through the aperture to form grommet 36 defining slot 34. The grommet pieces in this example are similar to those of FIG. 5 except that their stem portions are shortened due to the thinner material to be sandwiched between the grommet flanges.

Figure 10:
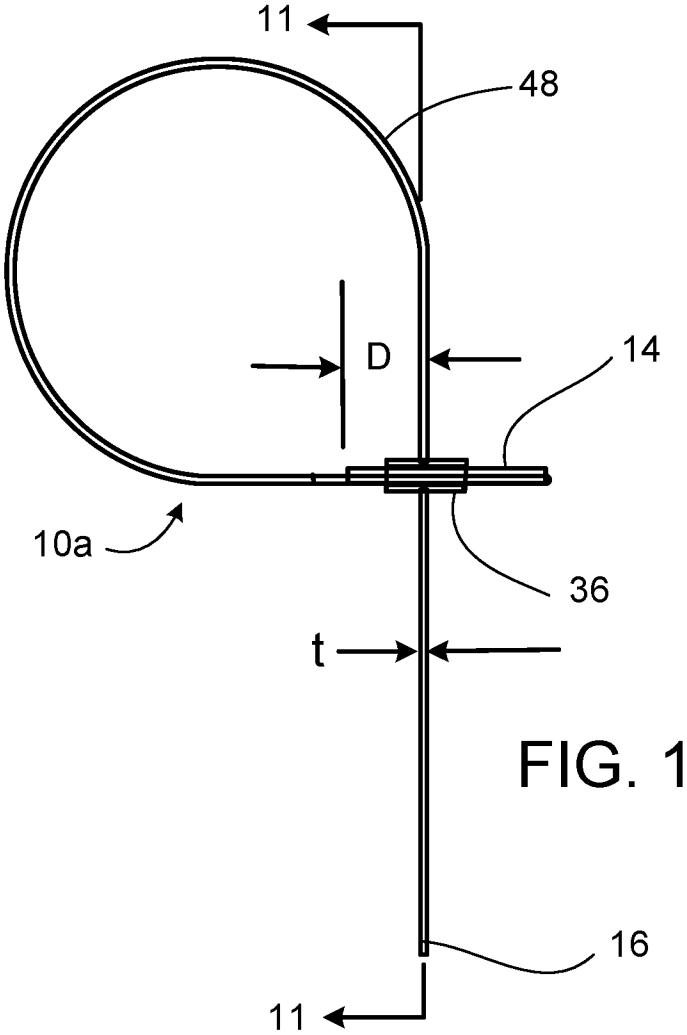
FIG. 10 is a side view of the strap of FIG. 1 extending through its slot.
Figure 9:
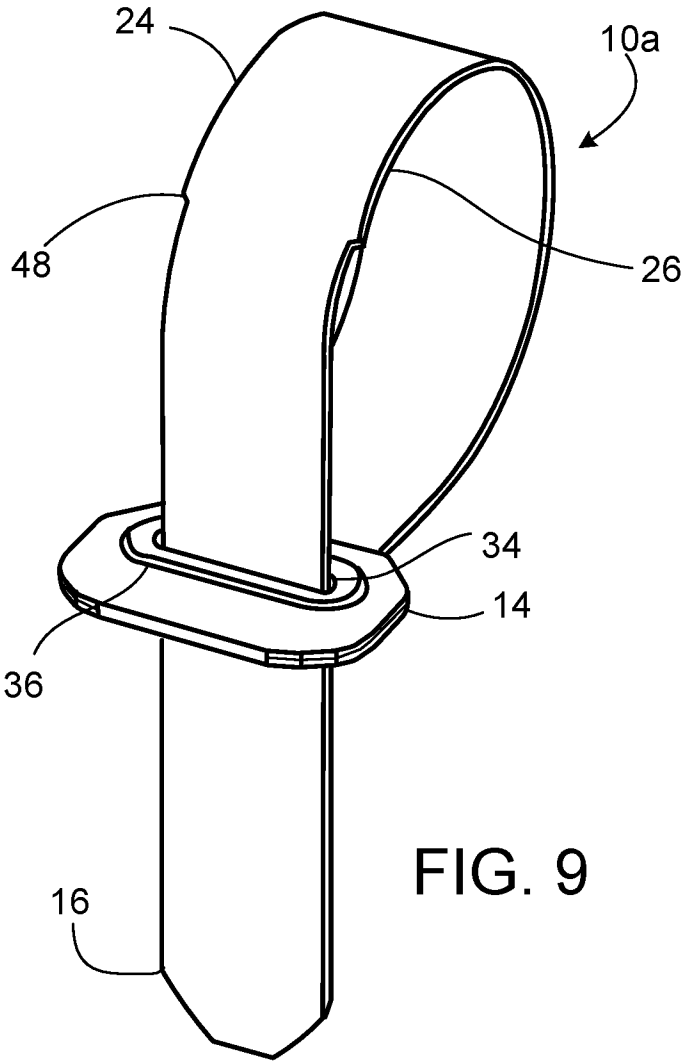
FIG. 9 is a perspective view of the strap of FIG. 1 extending through its slot.
Figure 11:
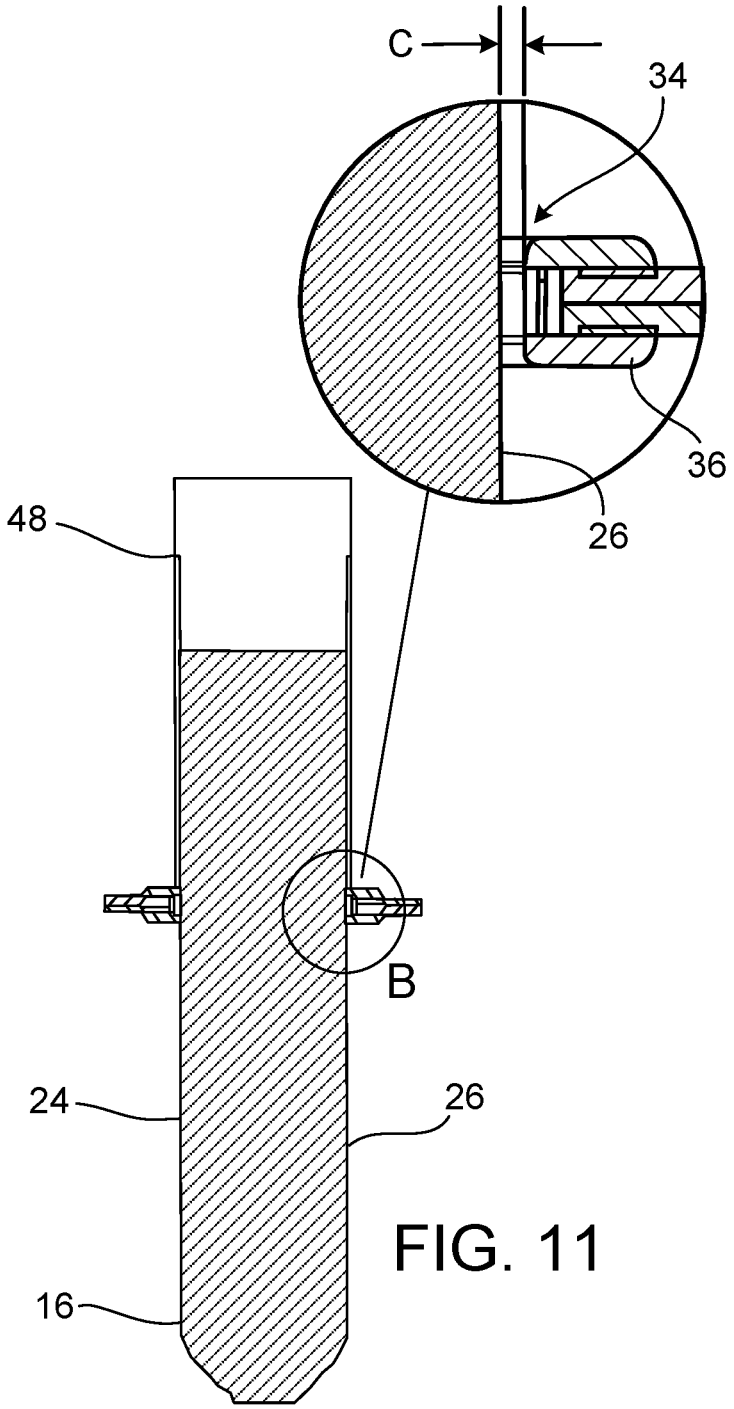
FIG. 11 is a cross-sectional view, taken along line 11-11 in FIG. 10.

Referring next to FIGS. 9 and 10, a similar strap 10*a* is shown with its distal end 16 inserted through its grommet slot. The only difference between this strap and the one shown in FIGS. 2-4 is that the end portion of strap 10*a* is slightly narrower than the portion nearer the head. Thus, there is a step 48 along the length of the strap where the nominal width steps up from a slightly narrower nominal width (on one side of step 48) to a slightly wider width (on the other side of step 48). In this case, the slightly narrower width is 25.4 mm and the slightly wider width is 26.0 mm. Referring also to FIG. 11, this step in width transitions the width from a width slightly narrower than the slot length (closer to the distal end) to a width equal to or slightly wider than the slot length (closer to the head). Thus, after initial insertion of the distal end of the strap into the slot, there is initially a clearance 'C' at either end of the slot and the strap can generally slide within the slot with little to no resistance. Clearance 'C' may be, for example, about 2.4 percent of the nominal width of the narrower portion of the strap, or about 0.6 mm in this example. The nominal width of the strap is preferably between 3.0 and 8.0 percent less than the transverse length of the slot, along the narrower portion of the strap tail from the distal end to step 48. Once the strap is pulled through the slot past step 48, the two ends of the slot bear against the opposite edges 24 and 26 of the strap, significantly increasing the resistance to movement of the strip within the slot. In this example, the entire strap other than the head has a nominal thickness 't' and the overall width of the strap in the wider or interference section is essentially equal to the slot length at the center of the slot, but because the strap has nominal thickness and the ends of the slot are curved, the edges of each face of the strap interfere with the inner grommet surface creating a resistance to motion. In this example, the step 48 is positioned at about the midpoint between head 14 and distal end 16, which simplifies the nesting of straps for die-cutting. Ideally, the step will be positioned such that most of the free length of the strap may be easily pulled through the slot and then the step engaged just before the strap cinches about the object it encircles. This can be particularly when the strap length is specifically configured for the application, such as in the manufacture of strapped goods. The wider portion of the strap thus forms an interference section, of a length of at least the distance 'D' from the slot to the neck between the head and the tail of the strap, and preferably greater than 50% of the overall head length LH, in which the width defined between the lateral edges is selected to define an interference fit with respect to the slot length, such that when the interference section is manually pulled into the slot, friction against the bounded ends of the slot retains the strap in the slot. For example, when used to bundle a cord, the strap is initially wrapped about a single section of the cord, with the tail pulled sufficiently through the slot to engage the interference section. The strap then remains in place on the cord during use, and for storage the cord is bundled and wrapped with the remaining tail, engaging itself to hold the bundled cord. The narrower portion of the tail facilitates threading into the slot.

Figure 13:
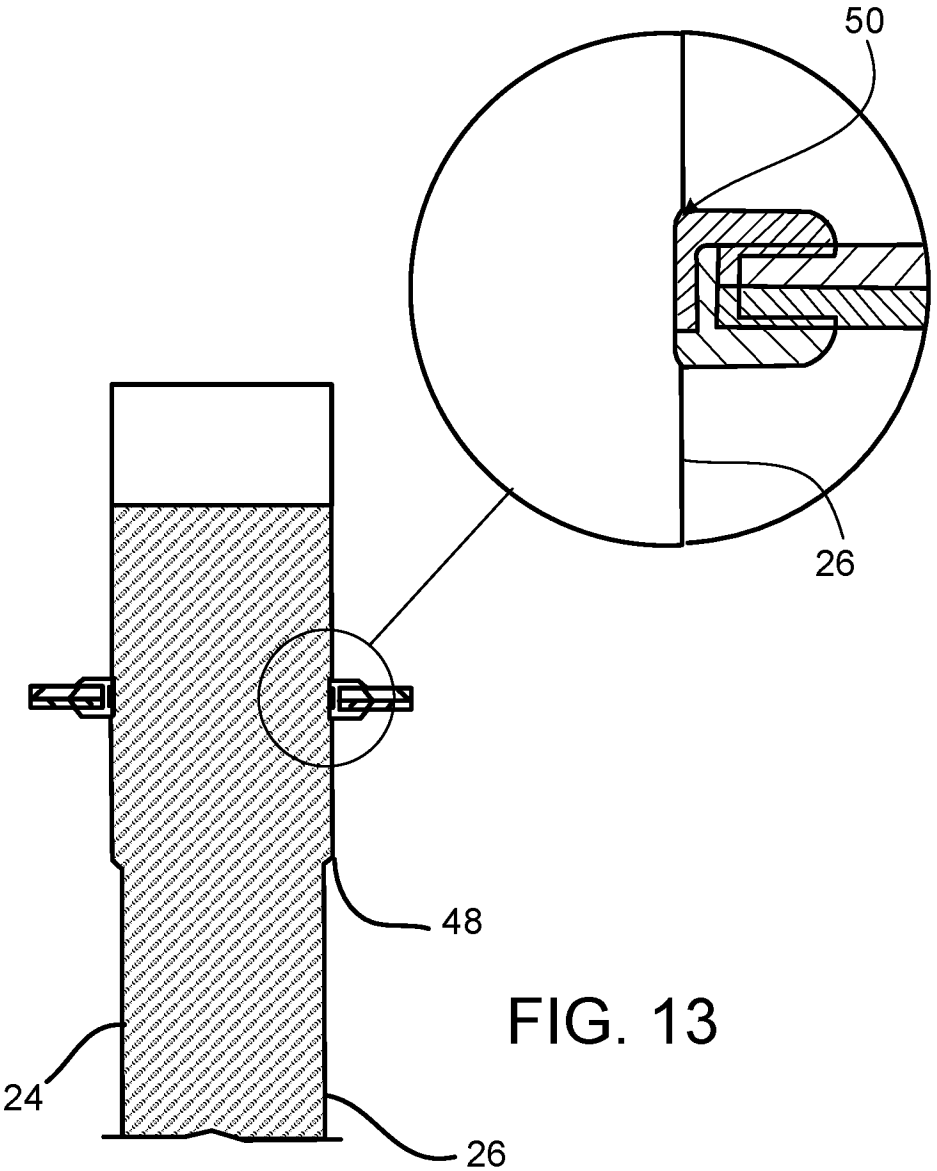
FIG. 13 is a cross-sectional view, taken along line 13-13 in FIG. 12.
Figure 12:
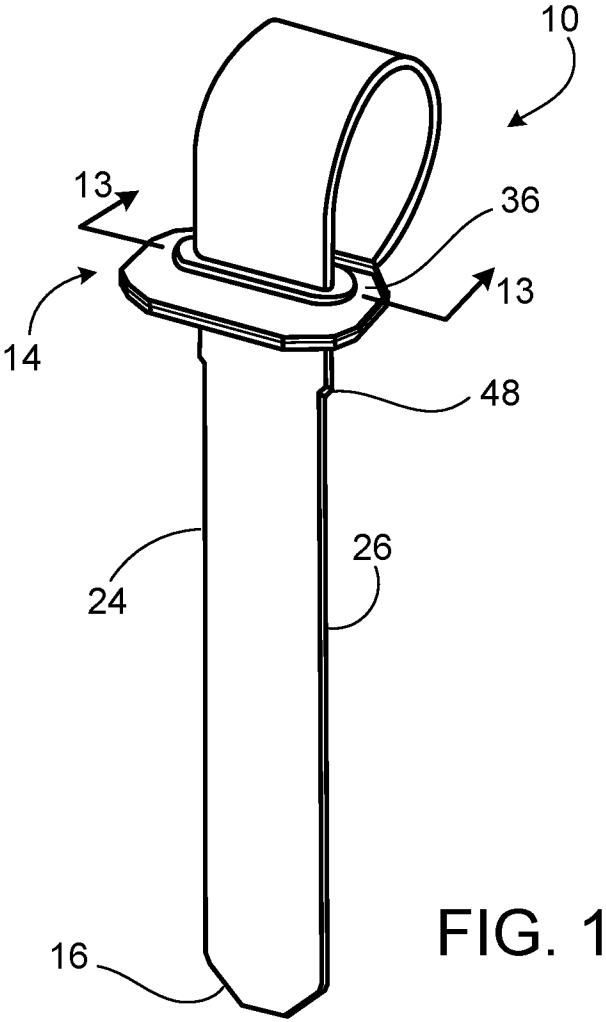
FIG. 12 is a perspective view of the strap of FIG. 9, threaded farther through the aperture.

FIGS. 12 and 13 illustrate the same strap 10*a* as in FIG. 9, pulled through the slot past the step 48 such that the wider interference section is in the slot. FIG. 13 also illustrates the interference or compression 50 between the strap edges and the ends of the slot, resisting sliding of the strap within the slot.

Figure 15:
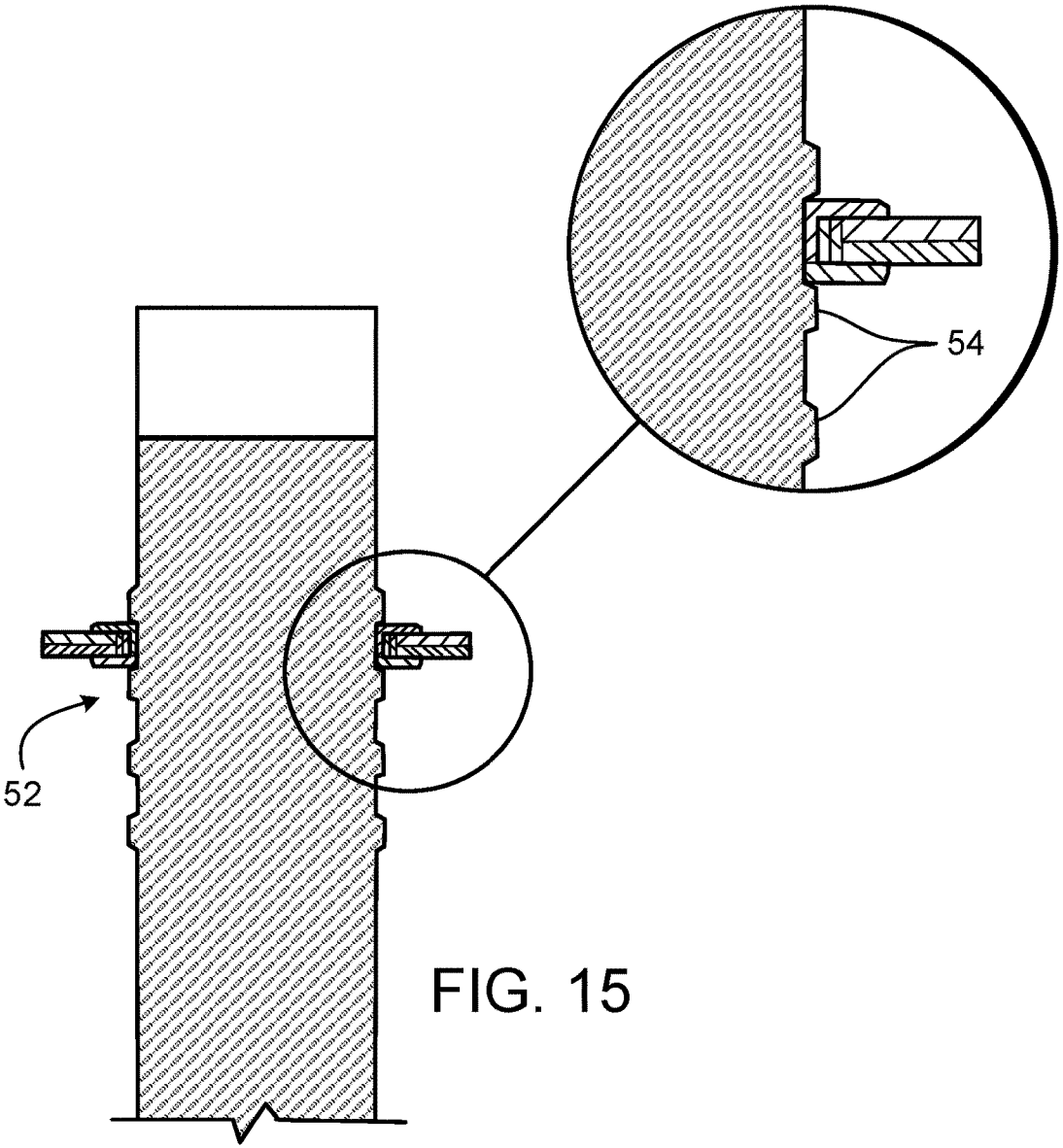
FIG. 15 is a cross-sectional view, taken along line 15-15 in FIG. 14.
Figure 14:
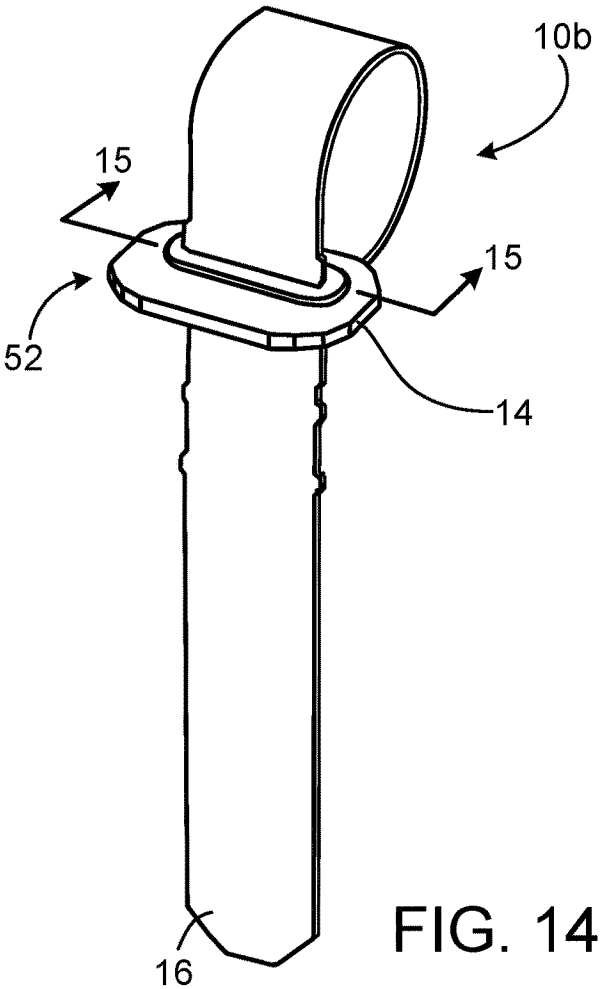
FIG. 14 is a perspective view of another strap.

FIGS. 14 and 15 similarly show a strap 10*b* of the same structure as that of FIG. 12, but in which there is an undulating width portion 52 in place of a single step between the narrower and wider portions of the strap. In undulating width portion 52 the width of the strap undulates between a minimum width similar to the width of the strap near the distal end 16, and a maximum width similar to a width near the head 14. The maximum width occurs at each of multiple peaks 54 along each side edge of the strap, spaced apart by side recesses 56 corresponding to the minimum width. The peaks and recesses of the undulations are both curved. When the undulating width portion is pulled through the slot, the pulling resistance undulates between a minimum and maximum corresponding to the width undulations. The minimum resistance could be as low as zero or could be a positive amount selected to provide some resistance to motion but be lower than the maximum resistance. The undulating width portion thus provides a tactile feedback to the user that he or she has reached the end of the free-motion length of strap, with motion through the undulating width portion providing an undulating resistance variation that signifies how far the strap has engaged, and can also provide a ratcheting tactile feedback.

Figure 16:
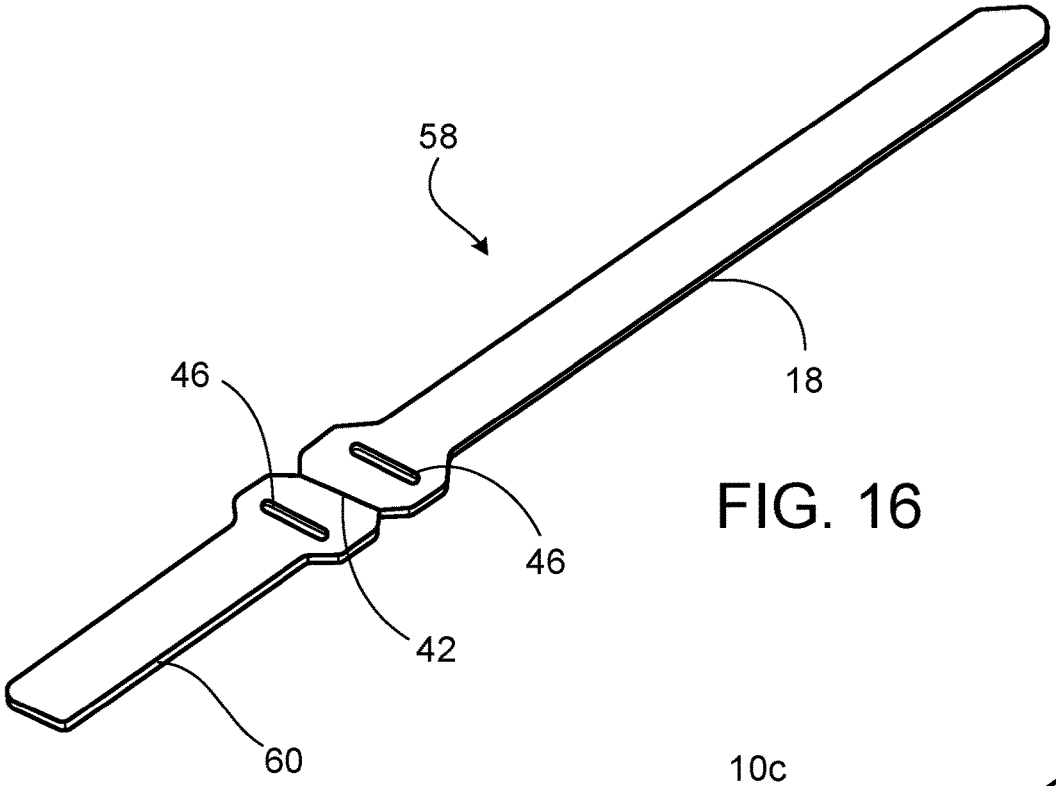
FIG. 16 is a perspective view of a strap preform.
Figure 17:
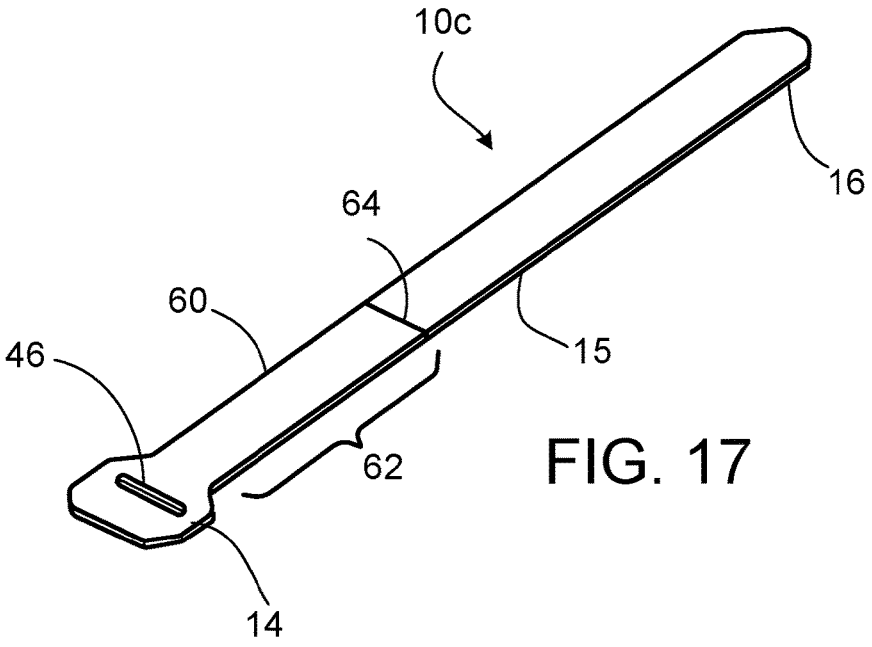
FIG. 17 is a perspective view of a strap formed from folding the preform of FIG. 16.

Referring next to FIGS. 16 and 17, another example of a strap 10*c* is formed from a die cut preform 58 of constant-thickness flexible material 18 (FIG. 16) shaped to have a double head and a short tail 60 extending in an opposite direction from the double head as the primary tail and of the same width as the primary tail. When the preform is folded at the perforation line 42, short tail 60 overlies the portion of the primary tail adjacent the double-thickness head of the resulting strap, such that the tail of the resulting strap 10*c* has a double-thickness portion 62 contiguous with the head 14, and a single-thickness portion extending to the strap tail end 16. This creates an abrupt step in thickness 64 at which the resistance to the strap tail being pulled through the aperture 46 increases. The aperture slot width is preferably such that there is some slight interference when the double-thickness portion 62 is pulled through the aperture. The preform is preferably folded such that the loop side of the flexible material is exposed on both sides of the head and double-thickness portion, and the hook side is only exposed from thickness step 64 to the tail end 16 of the strap. This example strap can consist entirely of the flexible material 18, as shown, or can be provided with a grommet defining the aperture, as discussed above. The facing hook surfaces in the head and double-thickness portion can be permanently fused together by sonic welding, as discussed above.

It should be noted with all of the above examples in which the width of certain portions of the strap are such that the strap edges bear against the ends of the slot to resist motion, such resistance is not the only means of retaining the strap about a wrapped object. Rather, the portion of the distal end of the strap extending through the slot is simply laid against the surface of the strap against the wrapped object, to releasably engage the cooperating touch fasteners on the opposite sides of the strap.

It should also be noted that the above grommet head structure may be employed to advantage on touch fastener straps of different arrangements of fastening elements. For example, such a head may be employed on a strap with both male and female fastening elements on the same side of the strap, such as with the female fastening elements covering a first length and the male fastening elements covering a second length. With the distal end of the strap pulled through the grommet slot and then folded back such that part of the first length, having been pulled through the slot, overlays part of the second length, wrapped against the object, the cooperating male and female fastener elements will releasably engage to hold the strap in place with a fold at the slot.

While a number of examples have been described for illustration purposes, the foregoing description is not intended to limit the scope of the invention, which is defined by the scope of the appended claims. There are and will be other examples and modifications within the scope of the following claims.

What is claimed is:

1. An elongated fastening strap, comprising a length of flexible material with two opposite faces bounded by lateral edges extending along the length of flexible material;

mutually engageable touch fastener elements carried on the faces of the flexible material to releasably fasten overlapping portions of the flexible material together with the fastening strap wrapped about an object;

wherein the length of flexible material has a perimeter shaped to form a head and a tail extending from the head to a distal end opposite the head, the tail having lateral edges defining a nominal width therebetween; and a grommet of greater thickness than the flexible material and secured to overlay the head on two opposite sides thereof, the head defining, at the grommet, a transverse slot of a length sufficient to receive therethrough the distal end of the tail.

2. The elongated fastening strap of claim 1, wherein the grommet forms an inner edge of the transverse slot.

3. The elongated fastening strap of claim 1, wherein the head is formed by two layers of the flexible material, joined at a fold.

4. The elongated fastening strap of claim 3, wherein the head has exposed surfaces carrying engageable loop fibers.

5. The elongated fastening strap of claim 3, wherein the two layers are permanently welded together across the head.

6. The elongated fastening strap of claim 1, wherein the nominal width is constant between the head and the distal end of the tail.

7. The elongated fastening strap of claim 1, wherein the tail includes an interference section, extending from the head toward the distal end of the tail a distance of at least half an overall length of the head and less than an overall length of the tail, in which the tail is of cross-sectional dimensions selected to define an interference fit with respect to the slot, such that when the interference section is manually pulled into the slot, friction in the slot retains the tail in the slot.

8. The elongated fastening strap of claim 7, wherein the interference section comprises two overlapped layers of the flexible material.

9. The elongated fastening strap of claim 7, wherein the slot length is at least as great as the nominal width in the interference section, the slot having curved ends that reduce the slot length toward sides of the slot and the interference section being of sufficient cross-section thickness that corners of the tail cross-section interfere with the curved ends of the slot.

10. The elongated fastening strap of claim 7, wherein the nominal width is greater along the interference section of the tail than in a distal section of the strap extending from the interference section to the distal end.

11. The elongated fastening strap of claim 7, wherein the tail includes an undulating width portion at an end of the interference section opposite the head, along which the width of the tail fluctuates between local minima and maxima, the width of the tail at the maxima selected to cause interference in the slot as the undulating width portion is pulled through the slot.

12. The elongated fastening strap of claim 1, wherein the flexible material comprises a laminate of a loop material forming one of the two opposite faces of the flexible material, and a resin layer carrying male touch fastener elements and forming the other of the two opposite faces of the flexible material.

13. The elongated fastening strap of claim 1, wherein the grommet comprises molded resin.

14. The elongated fastening strap of claim 13, wherein the touch fastener elements carried on one of the two opposite faces have discrete resin stems extending from a layer of resin, and wherein the molded resin of the grommet is of a higher durometer than the layer of resin.

15. The elongated fastening strap of claim 1, wherein the grommet consists of two identical grommet halves, each grommet half comprising a flange overlaying a respective side of the flexible material adjacent the slot.

16. The elongated fastening strap of claim 15, wherein the grommet halves are joined at a perimeter of the slot to form an inner edge of the slot.

17. The elongated fastening strap of claim 15, wherein the grommet halves are welded together about the slot.

18. The elongated fastening strap of claim 7, wherein the transverse slot length is between 3.0 and 8.0 percent greater than the nominal width of the tail.

* * * * *